US007380781B2

(12) United States Patent
Ikeda

(10) Patent No.: US 7,380,781 B2
(45) Date of Patent: Jun. 3, 2008

(54) SHEET FEEDING DEVICE AND IMAGE FORMING APPARATUS

(75) Inventor: Taro Ikeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/470,404

(22) Filed: Sep. 6, 2006

(65) Prior Publication Data

US 2007/0228638 A1 Oct. 4, 2007

(30) Foreign Application Priority Data

Mar. 28, 2006 (JP) ..... 2006-087006

(51) Int. Cl.
*B65H 3/14* (2006.01)

(52) U.S. Cl. ..... 271/98; 271/97; 271/103

(58) Field of Classification Search ..... 271/97, 271/98, 103

See application file for complete search history.

(56) References Cited

U.S. PATENT DOCUMENTS 3,596,900 A * 8/1971 Sundin ..... 271/98
3,837,638 A * 9/1974 Anderson et al. ..... 271/95
5,645,274 A 7/1997 Ubayashi et al. ..... 271/94
2006/0017209 A1 1/2006 Kushida et al. ..... 270/37
2006/0017218 A1 1/2006 Kawata et al. ..... 271/207
2006/0019811 A1 1/2006 Ikeda et al. ..... 493/444
2006/0170145 A1* 8/2006 Nakane ..... 271/97
2006/0288893 A1 12/2006 Ikeda ..... 101/407.1

FOREIGN PATENT DOCUMENTS

JP 7-196187 8/1995
JP 2003-182873 7/2003

* cited by examiner

*Primary Examiner*—Kaitlin S Joerger
(74) *Attorney, Agent, or Firm*—Fitzpatrick, Cella, Harper & Scinto

(57) ABSTRACT

A sheet feeding device which blows air to placed sheets, separates and conveys the sheets includes a sheet containing portion which contains the sheets, an air blowing portion which blows air to the sheets contained in the sheet containing portion, and an air supply unit which supplies air to the air blowing portion. The air supply unit is constituted by connecting two or more centrifugal fans, and the air blown out from an upstream side fan in an air flow passage is sucked by an adjacent downstream side fan via a spiral flow passage.

6 Claims, 10 Drawing Sheets

SHEET FEEDING DEVICE AND IMAGE FORMING APPARATUS

BACKGROUND OF THE INVENTION

1. Field of the Invention

The present invention relates to a sheet feeding device having a mechanism for blowing air to a placed sheet stack and floating and loosening the sheets.

2. Description of the Related Art

Conventionally, in sheet feeding devices provided in image forming apparatuses such as printers and copying machines, an air loosening mechanism which blows air to an end of sheet stack and floats and loosens the sheets is provided in order to securely feed sheets one by one from the sheet stack placed in a containing portion. As shown in FIG. 9, with the air loosening mechanism, air is blown to the end of the sheet stack contained in a containing portion 100 from a loosening nozzle 101 and a separation nozzle 102, a plurality of upper sheets are floated and loosened. The floated top sheet is stuck to a conveying belt 103 and is simultaneously conveyed so that the sheets are separated one by one. The separated sheets are further conveyed to a downstream side by a drawing-out roller pair 104 provided on a downstream side. The device having such a constitution is disclosed in, for example, Japanese Patent Application Laid-Open No. 7-196187.

An auxiliary air loosening mechanism, which blows air to a side of placed sheet stack (a direction perpendicular to a sheet feeding direction) and floats and loosens the sheets, is added so that also sheets of large size can be securely floated and loosened. As shown in FIG. 9, in this mechanism, auxiliary separating fans 105 and 106 are provided on a side of sheet stack, and air is blown to the side surface of the sheet stack from openings 105A and 106A, so that the sheets can be securely floated. The device having such a constitution is disclosed in, for example, Japanese Patent Application Laid-Open No. 2003-182873.

In the case where sheets to be fed are so-called coated paper which is used for printing and whose surface is coated with a coating material, the sheets are possibly stuck to each other. The sticking power of the sheets (the power of sticking the sheets) occasionally becomes 1 kgf or more according to temperature and humidity of a use environment. In such a case, two sheets which are stuck to each other are fed and also occasionally ten or more sheets which are stuck to each other are fed, thereby causing paper jam. In order to float heavy and large sheets whose basis weight is 200 g/m$^2$ or more, even if an influence of the sticking is not present, very strong wind pressure is required only for floating.

In the case where a device, which can output about 70 to 100 sheets of A4 size per minute, is assumed, loosening time per sheet reduces, and a sheet feeding condition becomes further strict.

For example, in the case where it is assumed that about 50 coated sheets of A3 size whose basis weight is 200 g/m$^2$ in an environment such that room temperature is 30° and relative humidity is 60 to 80% are output perminute, it is found according to an experiment that about 650 Pa of the wind pressure of air to be blown in order to securely float the sheets is necessary.

In centrifugal fans such as sirocco fans which are used in copying machines or the like being capable of outputting 50 to 70 sheets of A4 size per minute, comparatively large fans have a diameter of impeller which is about 80 mm to 120 mm. Such fans can obtain air whose pressure is higher than that of axial fans with the same diameter.

However, even in the case where a sirocco fan having impeller with a diameter of 120 mm is used, only the wind pressure of about 420 Pa is obtained.

In order to generate high-pressure air, a compressor or a large-sized centrifugal fan (for example, a turbo fan or a sirocco fan) is occasionally used, but devices mostly become large, heavy and expensive in all the cases. For this reason, a sheet feeding device becomes large and expensive.

SUMMARY OF THE INVENTION

The present invention is made in view of the above problem, and its object is to provide a sheet feeding device and an image forming apparatus which are capable of obtaining high wind pressure in an inexpensive and small constitution, securely loosening sheets, and preventing occurrence of overlapped feeding and paper jam.

The present invention for solving the above problem provides a sheet feeding device having an air loosening mechanism for blowing air to placed sheets so as to loosen the sheets, including: a sheet containing portion which contains the sheets; an air blowing portion which blows air to ends of the sheets contained in the sheet containing portion; and an air supply unit which supplies air to the air blowing portion. The air supply unit has a plurality of centrifugal fans and is constituted so that the centrifugal fans are connected serially by a spiral flow passage.

DESCRIPTION OF THE EMBODIMENTS

A sheet feeding device and an image forming apparatus provided therewith according to one embodiment of the present invention are explained below with reference to the drawings.

[Entire Constitution of the Image Forming Device]

An entire constitution of the image forming apparatus provided with the sheet feeding device to which the present invention is applied is explained together with an image forming operation.

Figure 6:
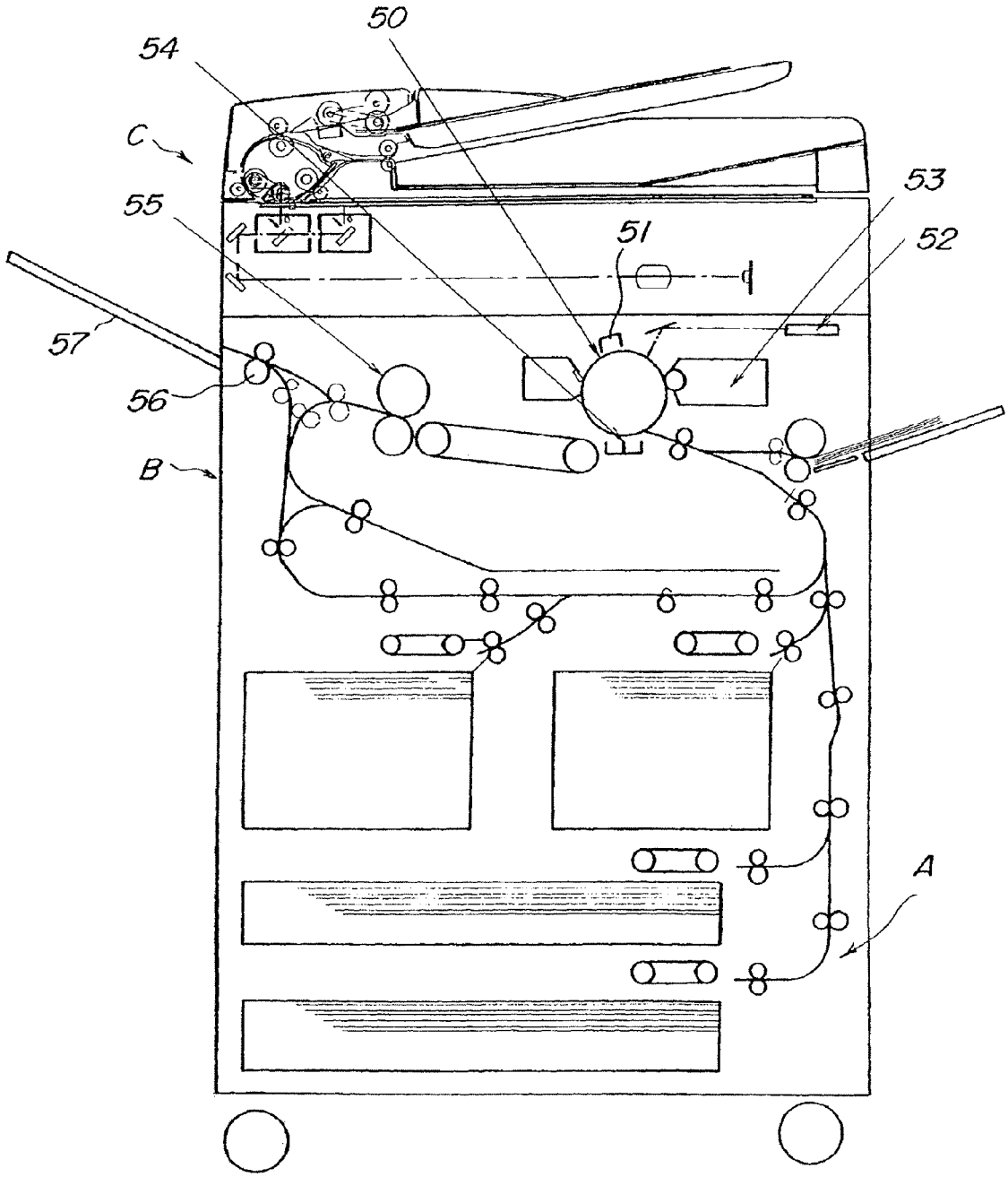
FIG. 6 is a schematic sectional explanatory diagram illustrating an image forming apparatus having a sheet feeding device.

FIG. 6 is a schematic sectional explanatory diagram of the image forming apparatus having the sheet feeding device. In the image forming apparatus according to this embodiment, as shown in FIG. 6, the sheet feeding device A is arranged on a lower part of an image forming apparatus main body (hereinafter, apparatus main body), and an image forming portion B which forms an image on a sheet fed from the sheet feeding device A is arranged on an upper part of the apparatus main body. An image reading portion C which optically reads information about an original and converts the information into a digital signal so as to obtain an image signal is arranged on the apparatus main body.

When an image is formed, an image signal read by the image reading portion C is transmitted to the image forming portion B as an image forming means, and the image forming portion B forms an image on a sheet fed from the sheet feeding device A based on the image signal. The image formation in this embodiment is an electrophotographic type. Concretely, when an image forming signal is input, a photosensitive drum 50 rotates, and its surface is charged by a charger 51. A laser beam is emitted from a laser scanner 52 to the photosensitive drum 50 based on the above read image signal, and an electrostatic latent image is formed on the photosensitive drum 50. The electrostatic latent image formed on the photosensitive drum 50 is developed by a developer 53 using toner, so that a visible image is obtained.

On the other hand, a sheet sent from the sheet feeding device A is conveyed between the photosensitive drum 50 and a transfer charger 54 so that the conveying synchronizes with the formation of the toner image. The toner image on the photosensitive drum 50 is transferred to the sheet by bias application to the transfer charger 54. The sheet to which the toner image is transferred is conveyed to a fixing device 55 and is heated and is subject to a pressurizing process. After the toner image is permanently fixed to the sheet, the sheet is discharged onto a discharge tray 57 by a discharge roller pair 56.

[Sheet Feeding Device]

A constitution of the sheet feeding device A according to this embodiment is explained together with a separation feeding operation of the sheets.

Figure 7:
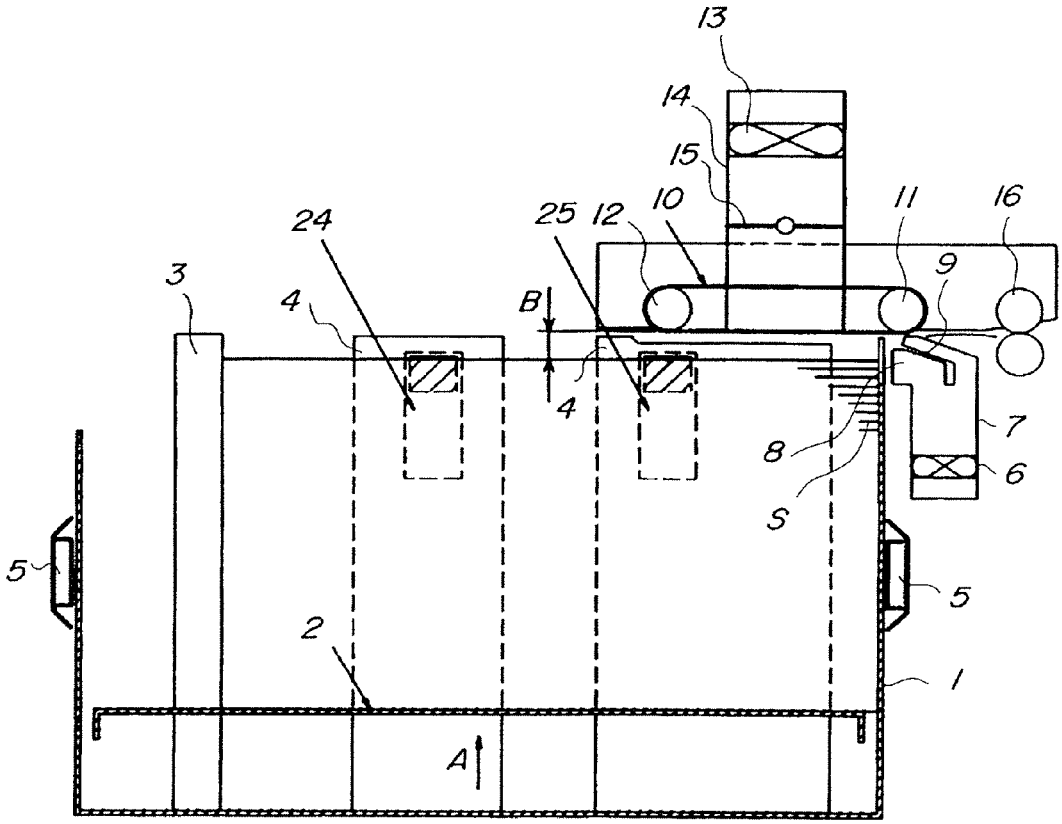
FIG. 7 is an explanatory diagram illustrating the sheet feeding device.
Figure 8:
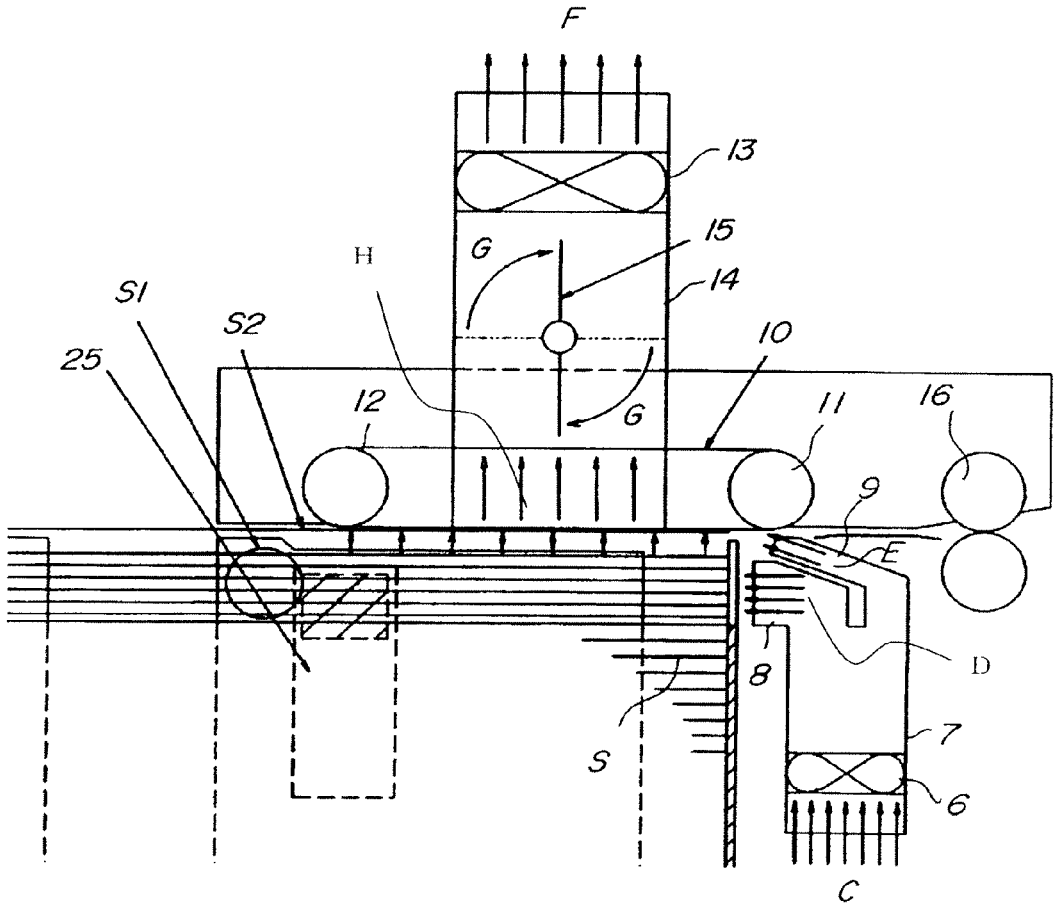
FIG. 8 is an explanatory diagram illustrating an air adsorption separation feeding constitution.
Figure 9:
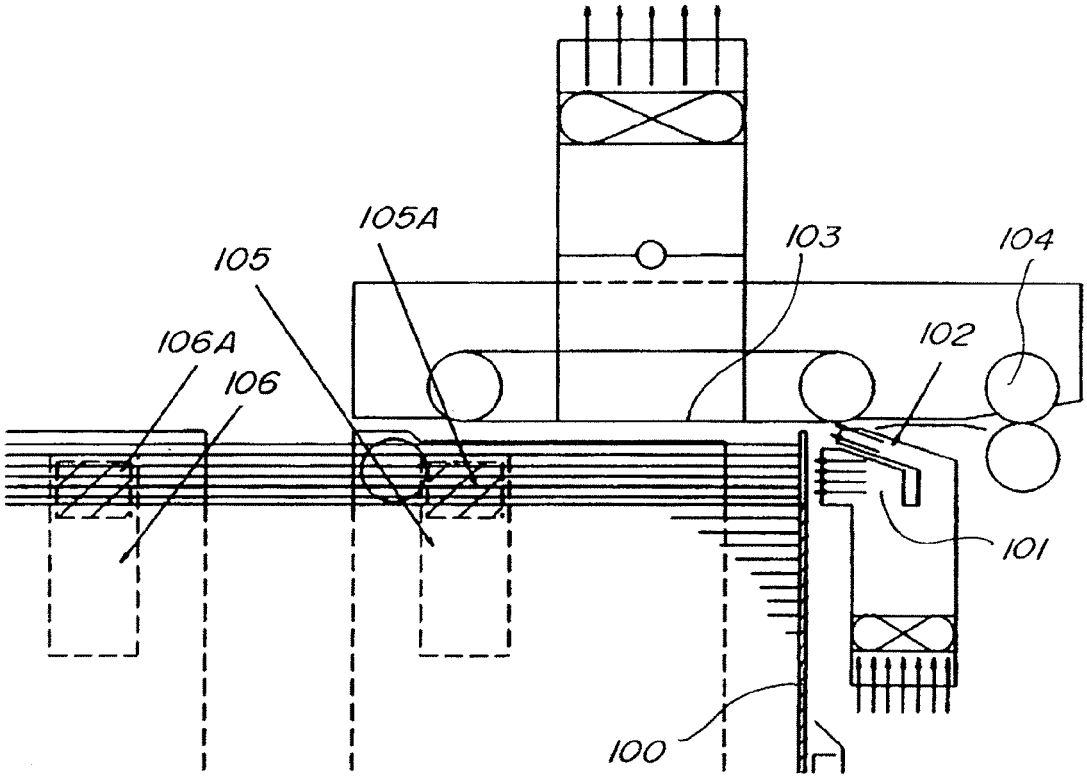
FIG. 9 is an explanatory diagram illustrating the air adsorption separation feeding constitution according to a conventional art.

FIGS. 7 and 8 are schematic explanatory diagrams of the sheet feeding device in this embodiment. In the sheet feeding device A of this embodiment, air is blown to the end of sheet stack and the sheets are loosened to be fed. In FIG. 7, a sheet containing portion 1 which contains sheets has a tray 2 on which sheet stack is placed, a rear end regulating plate 3 that regulates an upstream side of the conveyance direction of the sheets, and a side end regulating plate 4 which regulates a sheet widthwise direction as a direction perpendicular to the conveyance direction. The rear end regulating plate 3 and the side end regulating plate 4 are constituted so that their positions are arbitrarily changed according to sizes of sheets.

The sheet containing portion 1 is supported so as to be capable of being inserted into and drawn out of the apparatus main body by a slide rail 5. The direction where the sheet containing portion 1 is drawn out from the apparatus main body is a direction vertical to a sheet surface of FIG. 6.

In FIG. 7, a user draws out the sheet containing portion 1 from the apparatus main body, sets sheet stack on the tray 2, and again attaches the sheet containing portion 1 to the apparatus main body. As a result, the tray 2 starts to be ascended to a direction of an arrow A in FIG. 7 by a driving unit, not shown. The tray 2 stops in a position where the top sheet of the placed sheet stack is separated from a sticking conveying belt 10 by a distance B set in advance so that the apparatus waits for a feeding signal.

An air loosening mechanism, which blows air to the sheet stack contained in the sheet containing portion 1 and floats to loosen the sheets is provided to a downstream side of the sheet containing portion 1 in the sheet conveyance direction. The air loosening mechanism has an air supply unit 6 which supplies air and an air blowing portion which blows air supplied from the air supply unit 6 to the end of the sheet stack. The air supply unit 6 is provided with a separation duct 7, a loosening nozzle 8 and a separation nozzle 9. In FIG. 7, the air supply unit 6 is drawn in a pattern manner, but details of the constitution are explained below.

When the air supply unit 6 operates based on the feeding signal, the air is sucked to a direction of an arrow C in FIG. 8, and the sucked air is blown out from the loosening nozzle 8 and the separation nozzle 9 to the end of the sheet stack from directions of arrows D and E in FIG. 8 via the separation duct 7. When the air is blown to the end of the sheet stack S from the loosening nozzle 8 and the separation nozzle 9, some upper sheets S1 in the sheet stack S float to be loosened. Auxiliary separation fans 24 and 25 which blown air to side surface of the sheet stack are provided so as to ensure the floating of the sheets S1.

On the other hand, a sticking conveying portion which sticks and conveys the sheets floated by blowing air by means of the air blowing portion is provided above the sheet stack. The sticking conveying portion is provided rotatively so that an endless conveying belt 10 having a suction hole, not shown, is suspended between a driving roller 11 and a driven roller 12. A sticking fan 13 is provided to the sticking conveying portion. The sticking fan 13 is operated and air is blown out to a direction of an arrow F in the drawing, so that the top sheet in the sheet stack is stuck to the conveying belt 10. A sticking shutter 15 is provided into a duct 14 of the sticking fan 13, and when the sticking shutter 15 is opened and closed, the sticking and non-sticking of the sheet to the conveying belt 10 are controlled.

The sticking shutter 15 is closed when the sheets firstly float due to the blowing of air by means of the air blowing portion. When the feeding signal is detected, predetermined time passes and the floating of the sheets S1 becomes stable so as to be loosened sufficiently, as shown in FIG. 8, the sticking shutter 15 is rotated to a direction of an arrow G. As a result, the sticking power (negative pressure) from the suction hole provided on the conveying belt 10 to a direction of an arrow H is generated, and the top sheet S2 is stuck to the conveying belt 10. The driving roller 11 is rotated in this state so that the sheet which is stuck to the conveying belt 10 can be conveyed.

A drawing-out roller pair 16 as a conveying portion which conveys sheets conveyed by the conveying belt 10 is arranged on a downstream side of the sticking conveying portion. The sheet which is stuck and conveyed by the conveying belt 10 is sent to a conveying passage by the drawing-out roller pair 16, so as to be conveyed to the image forming portion.

[Air Supply Unit]

A constitution of the air supply unit is explained below with reference to FIGS. 1 to 5.

Figure 1:
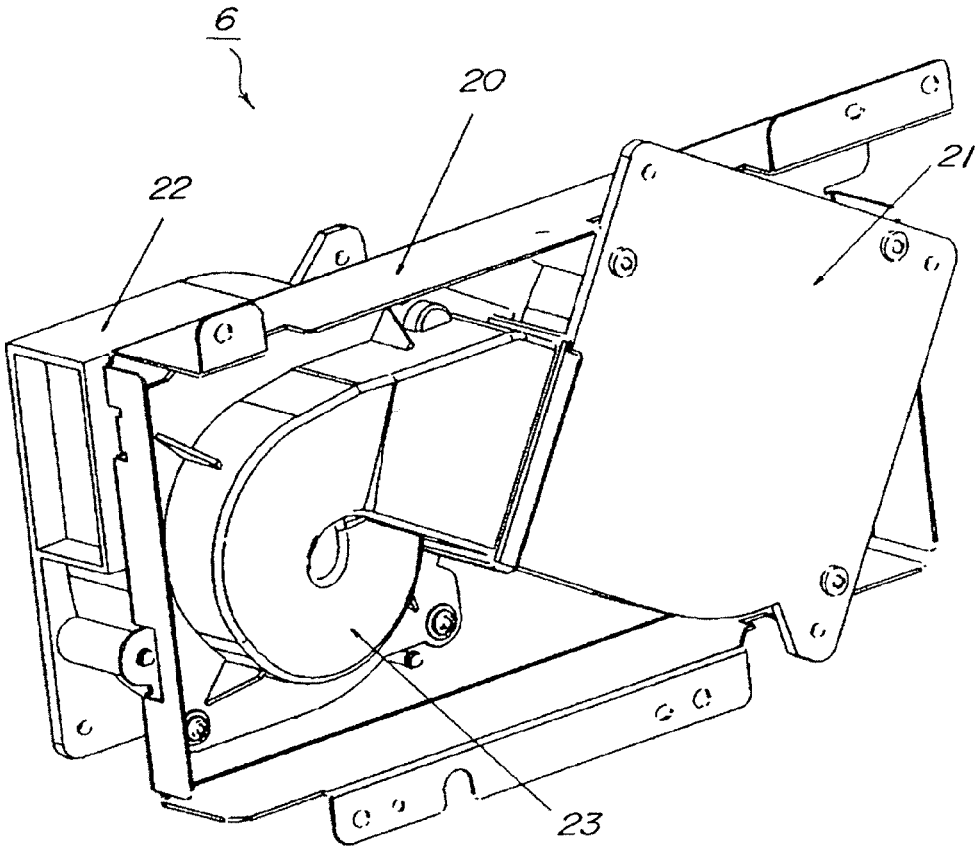
FIG. 1 is a perspective explanatory diagram illustrating an air supply unit.
Figure 2:
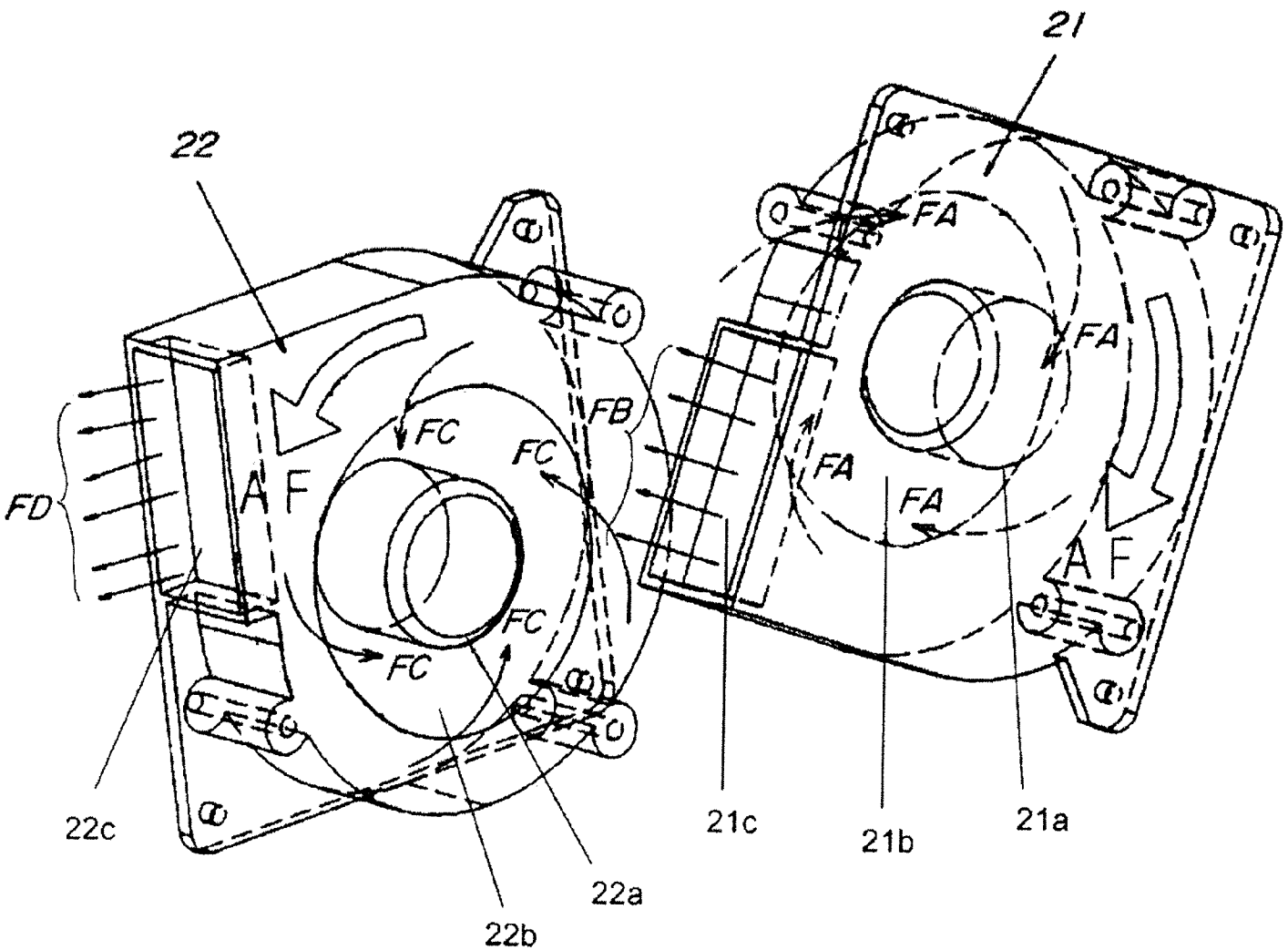
FIG. 2 is an explanatory diagram illustrating a flow of air in two centrifugal fans taken out from the constitution of FIG. 1.

FIG. 1 is a perspective view illustrating the air supply unit. FIG. 2 is a diagram illustrating only two fans taken out from the constitution in FIG. 1, and illustrates a flow of air when the fans are driven.

In FIGS. 1 and 2, two centrifugal fans (for example, sirocco fans or turbo fans) 21 and 22 used in the air supply unit 6 have the approximately same constitution. The centrifugal fans 21 and 22 have a fan in which an impeller (not shown) is attached to rotating shafts 21*a* and 22*a*, air suction openings 21*b* and 22*a* which open in a direction perpendicular to the axial directions of the rotating shafts 21*a* and 22*a*, and air supply openings 21*c* and 22*c* which open sideways. The air supply unit 6 in this embodiment is fixed to front and rear of a supporting pedestal 20 so that the air supply openings 21*c* and 22*c* of the two centrifugal fans 21 and 22 face the approximately same direction and the air suction openings 21*b* and 22*b* face opposite directions. As a result, the centrifugal fans 21 and 22 are arranged so as to be shifted in a front-rear direction (the axial directions of the rotating shafts 21*a* and 22*a*). A connecting member 23 which connects the air supply opening 21*c* of the centrifugal fan 21 to the air suction opening 22*b* of the centrifugal fan 22 is arranged in a space formed by shifting the centrifugal fans 21 and 22 in the front-rear direction. As a result, the centrifugal fan 21 and the centrifugal fan 22 are connected serially, so that one air flow passage through which air flows from the centrifugal fan 21 to the centrifugal fan 22 is formed. The centrifugal fan 21 on the upstream side of the air flow passage is called hereinafter "the upstream side fan 21", and the centrifugal fan 22 on the downstream side of the air flow passage is called hereinafter "the downstream side fan 22".

When the impellers of the centrifugal fans 21 and 22 start to rotate to a direction of an arrow AF in FIG. 2, air is sucked from a direction of an arrow FA in the drawing to the upstream side fan 21 in an axial direction of the impeller and the air is blown out from the air supply opening 21*c* to a direction of an arrow FB in the drawing. The air is sucked from a direction of an arrow FC in the drawing to the downstream side fan 22 and is blown out from the air supply opening 22*c* to a direction of an arrow FD in the drawing.

Figure 3A:
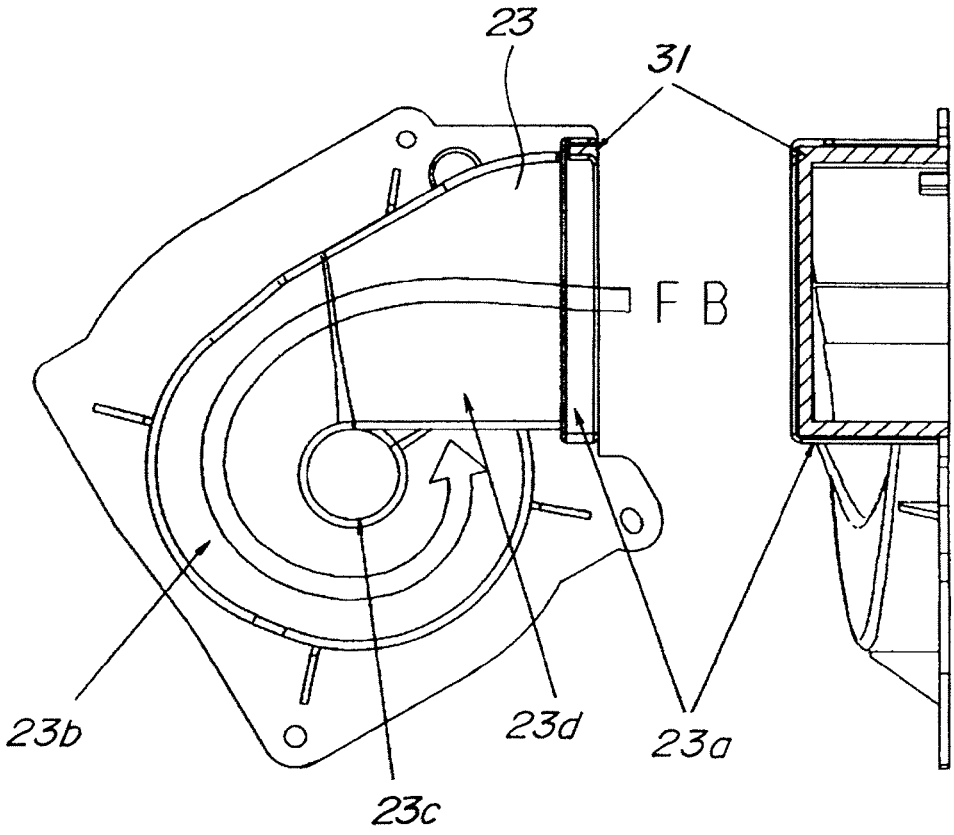
FIGS. 3A and 3B are explanatory diagrams illustrating a connecting member that connects the two centrifugal fans.
Figure 3B:
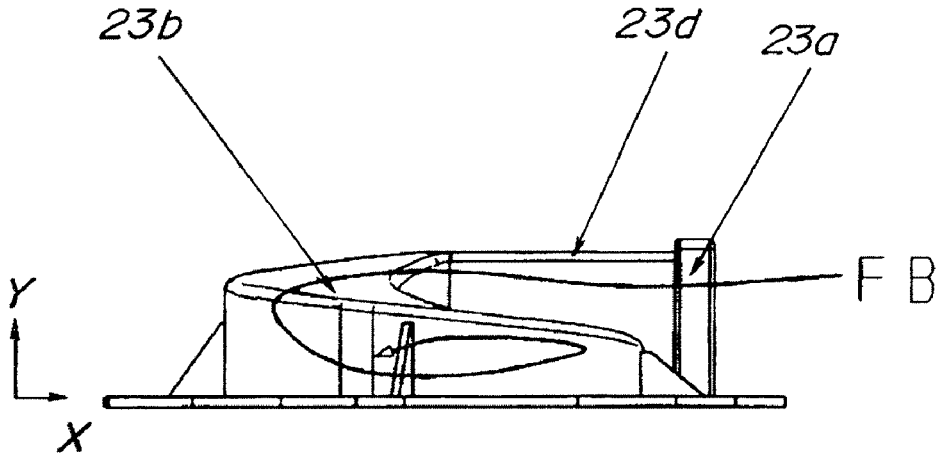

FIGS. 3A and 3B are explanatory diagrams illustrating the connecting member 23 which forms a spiral flow passage 23*b* and the flow of the air in the state that the two centrifugal fans 21 and 22 are connected. As to the connecting member 23, its one end is connected to the air supply opening 21*c* of the centrifugal fan 21, and the other end is connected to the air suction opening 22*b* of the centrifugal fan 22. An air inlet 23*a* of the connecting member 23 is formed so that its size matches with the supply opening 21*c* of the upstream side fan 21, and it is sealed by a soft sealing member 31 (a slanted line portion in the drawing) such as sponge in order to prevent air leakage.

Air FB blown out from the upstream side fan 21 turns in the spiral flow passage 23*b* of the connecting member 23 and simultaneously flows so as to be sucked as air FC of the downstream side fan 22 in FIG. 2. The flow of the air in the spiral flow passage 23*b* is called a rotational flow. At this time, after the flow passage is gradually narrowed in an inside 23*d* of the connecting member 23 as shown in FIGS. 3A and 3B, the air is led to the spiral flow passage 23*b* so that air flows smoothly.

As shown in FIG. 3A, the spiral flow passage 23*b* is formed so that the rotational flow of the air is counterclockwise in the drawing. As shown in FIG. 3B, the height (thickness) of the spiral flow passage 23*b* becomes gradually low in a direction Y in the drawing. A cylindrical separation wall 23*c* is provided at the center of the spiral, so that the air FB flows efficiently.

The direction of the rotational flow of the air in the spiral flow passage 23*b* is set so as to be the same as the rotational direction of the impeller of the downstream side fan 22. In this embodiment, the center of the rotational flow of the air in the spiral flow passage 23*b* is approximately equal to the rotational center of the impeller of the downstream side fan 22. With such a constitution, the flow of the air passing through the spiral flow passage 23*b* is led smoothly to the downstream side fan 22.

When the upstream side fan 21 and the downstream side fan 22 are arranged serially and they are connected by the spiral flow passage 23*b*, the air blown out from the upstream side fan 21 flows into the downstream side fan 22 smoothly. For this reason, when the rotation of the impeller of the downstream side fan 22 is accelerated, the compression efficiency of the air rises, so that high-pressure air can be output.

In the case where about 50 pieces of coated paper of A3 size whose basis weight is 200 g/m$^2$ in an environment that room temperature is 30° and relative humidity is about 60 to 80% are output per minute, the air supply unit 6 requires the wind pressure of about 650 Pa. Therefore, the wind pressure of the air supply unit 6 in this embodiment was measured under the same condition, and the finally obtained wind pressure was about 690 to 710 Pa.

The air supply opening 22*c* is connected to the separation duct 7 in FIG. 8, and the air blown out from the air supply opening 22*c* is blown to an end of the sheet stack from the loosening nozzle 8 and the separation nozzle 9 via the separation duct 7. About 50 pieces of coated paper of A3 size whose basis weight is 200 g/m$^2$ in the environment that room temperature is 30° and relative humidity is about 60 to 80% are output per minute by using the sheet feeding device having the air supply unit 6 in this embodiment. As a result, overlapped feeding and paper jam do not occur, and thus satisfactory feeding is enabled.

Figure 4:
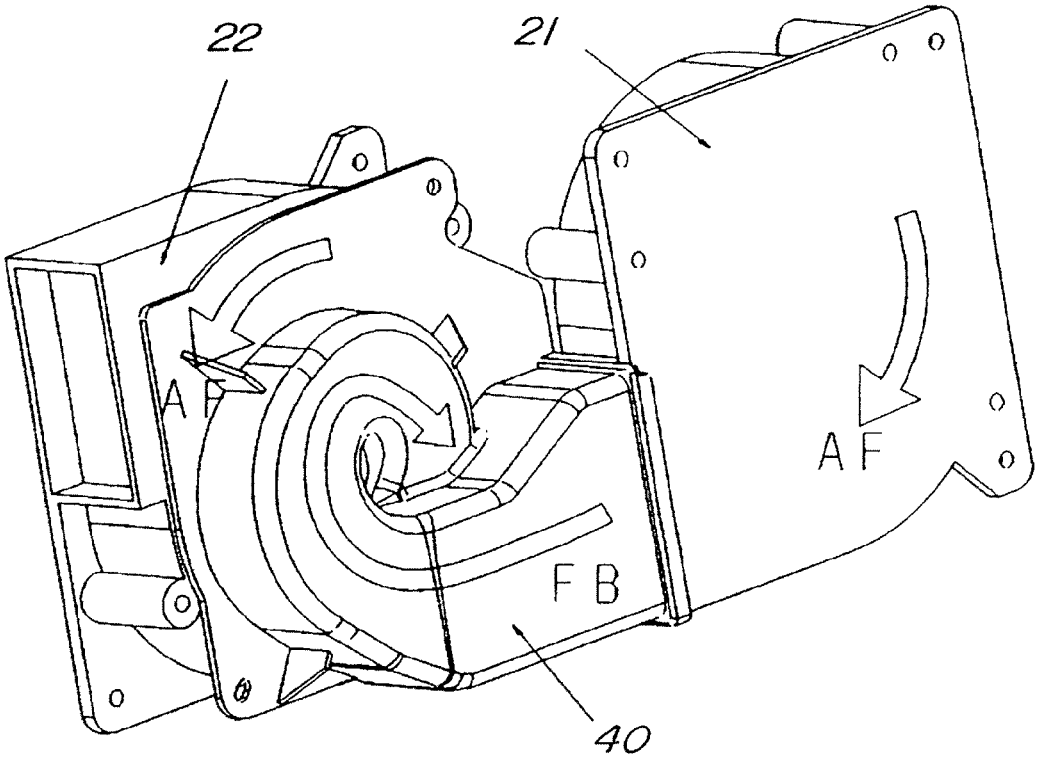
FIG. 4 is an explanatory diagram illustrating an example where a revolving direction of a spiral flow passage of the connecting member is different from a rotating direction of impeller of the downstream side fan.

As shown in FIG. 4, a case where the rotational flow direction of the air in the spiral passage of the connecting member 23 is opposite to the rotating direction of the impeller of the downstream side fan 22 is explained. In FIG. 4, the rotating directions of the impellers of the upstream side fan 21 and the downstream side fan 22 are AF which is the same as the aforementioned direction. The air FB from the upstream side fan 21, however, flows into the downstream side fan 22 in a clockwise direction opposite to the rotating direction of the downstream side fan 22 by the connecting member 40.

In this case, the air flows to the direction opposite to the rotating direction AF of the impeller of the downstream side fan 22. When the wind pressure is measured in this state, the obtained wind pressure is reduced by about 10% in comparison with the case where the connecting member 23 having the spiral passage set so that the air flows to the same direction as the rotating direction of the downstream side fan 22 is used so that the air is guided to the downstream side fan 22.

As a result, in order to obtain the high wind pressure by connecting the two centrifugal fans serially, it is preferable that the connecting member 23 is used to guide the air from the upstream side fan 21 to the same direction as the rotating direction of the impeller of the downstream side fan 22.

Figure 5:
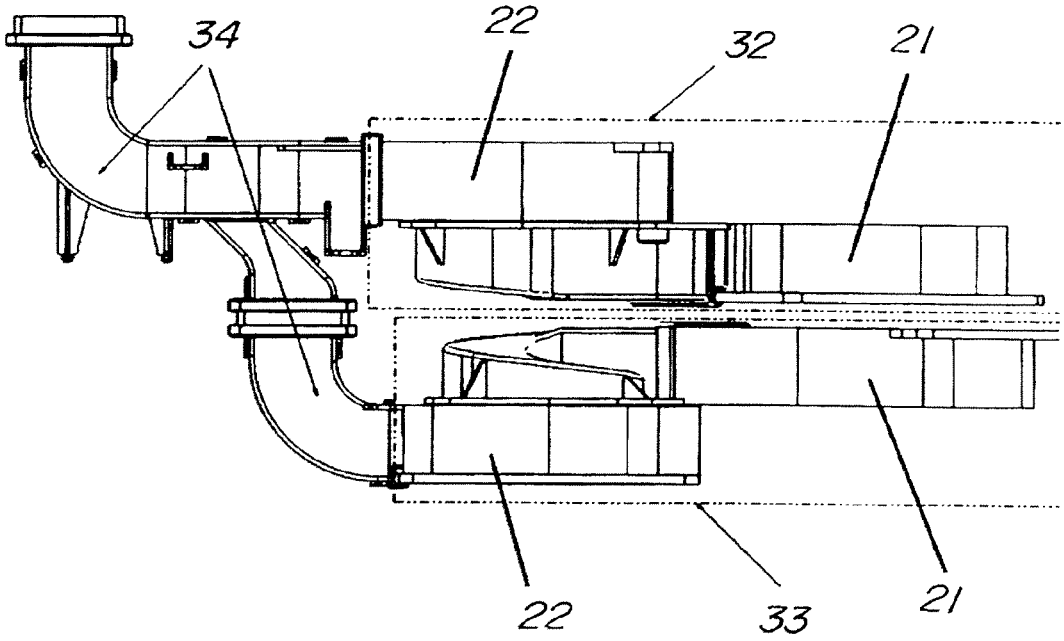
FIG. 5 is a constitutional explanatory diagram illustrating an air supply unit having two units composed of the upstream side fan and the downstream side fan.

In this embodiment, the two centrifugal fans are connected serially so that the air supply unit is constituted, but it may be constituted as shown in FIG. 5. The air supply unit in FIG. 5 is constituted so that the upstream side fan 21 and the downstream side fan 22 are connected by the connecting member 23 serially as one unit. The two units 32 and 33 are arranged in parallel, and the downstream sides of the units 32 and 33 in the air flowing direction are connected so that air is blown out from one place. A wind passage member 34 is connected to the separation duct 7 in FIG. 8, and the air blown out from the air supply opening 22*c* is blown to the end of the sheet stack from the loosening nozzle 8 and the separation nozzle 9 via the separation duct 7. With such a constitution, the air of high wind pressure can be supplied even by using small centrifugal fans.

The above embodiment explains the example that the two centrifugal fans are connected serially, but the air blown out from the upstream side fan is sucked by the adjacent downstream side fan via the spiral flow passage so that three or more fans may be connected serially.

Further, in this embodiment, the two centrifugal fans of the same size and ability are combined, but the abilities of the fans may be different. In this case, it is desirable that the fan having the higher ability is arranged on the upstream side.

This application claims the benefit of priority from the prior Japanese Patent Application No. 2006-087006 filed on Mar. 28, 2006 the entire contents of which are incorporated by reference herein.

What is claimed is:

1. A sheet feeding device having an air loosening mechanism for blowing air to placed sheets so as to loosen the sheets, the sheet feeding device comprising:

a sheet containing portion which contains the sheets;

an air blowing portion which blows air to ends of the sheets contained in the sheet containing portion; and an air supply unit which supplies air to the air blowing portion, wherein the air supply unit has a plurality of centrifugal fans, wherein a connecting member connects an air supply opening of the centrifugal fan on an upstream side with respect to a direction of air flow and an air suction opening of the centrifugal fan on a downstream side with respect to the direction of air flow, wherein the centrifugal fans are connected serially by a spiral flow passage formed by the connecting member, and wherein a rotational flow direction of the air in the spiral flow passage is set so as to be the same as a rotating direction of an impeller of the centrifugal fan on the downstream side.

2. A sheet feeding device having an air loosening mechanism for blowing air to placed sheets so as to loosen the sheets, the sheet feeding device comprising:

a sheet containing portion which contains the sheets;

an air blowing portion which blows air to ends of the sheets contained in the sheet containing portion; and an air supply unit which supplies air to the air blowing portion, wherein the air supply unit has a plurality of centrifugal fans, wherein a connecting member connects an air supply opening of the centrifugal fan on an upstream side with respect to a direction of air flow and an air suction opening of the centrifugal fan on a downstream side, wherein the centrifugal fans are connected serially by a spiral flow passage formed by the connecting member, and wherein a center of the rotational flow of the air in the spiral flow passage is equal to the rotating center of the impeller of the centrifugal fan on the downstream side.

3. The sheet feeding device according to claim 1 or 2, wherein a plurality of air supply units constituted by combining the plural centrifugal fans serially are arranged in parallel, and the respective air supply units are connected at the downstream side in the air flow direction.

4. An image forming apparatus including a sheet feeding device having an air loosening mechanism for blowing air to placed sheets to loosen the sheets and an image forming portion for forming an image on sheets fed from the sheet feeding device, the image forming apparatus comprising:

a sheet containing portion which contains the sheets;

an air blowing portion which blows air to ends of the sheets contained in the sheet containing portion; and an air supply unit which supplies air to the air blowing portion, wherein the air supply unit has a plurality of centrifugal fans, wherein a connecting member connects an air supply opening of the centrifugal fan on an upstream side with respect to a direction of air flow and an air suction opening of the centrifugal fan on a downstream side, wherein the centrifugal fans are connected serially by a spiral flow passage formed by the connecting member, and wherein a rotational flow direction of the air in the spiral flow passage is set so as to be the same as a rotating direction of an impellar of the centrifugal fan on the downstream side.

5. An image forming apparatus including a sheet feeding device having an air loosening mechanism for blowing air to placed sheets to loosen the sheets and an image forming portion for forming an image on sheets fed from the sheet feeding device, the image forming apparatus comprising:

a sheet containing portion which contains the sheets;

an air blowing portion which blows air to ends of the sheets contained in the sheet containing portion; and an air supply unit which supplies air to the air blowing portion, wherein the air supply unit has a plurality of centrifugal fans, wherein a connecting member connects an air supply opening of the centrifugal fan on an upstream side with respect to a direction of air flow and an air suction opening of the centrifugal fan on a downstream side, wherein the centrifugal fans are connected serially by a spiral flow passage formed by the connecting member, and wherein a center of the rotational flow of the air in the spiral flow passage is equal to the rotating center of the impeller of the centrifugal fan on the downstream side.

6. The sheet feeding device according to claim 4 or 5, wherein a plurality of air supply units constituted by combining the plural centrifugal fans serially are arranged in parallel, and the respective air supply units are connected at the downstream in the air flow direction.

* * * * *

UNITED STATES PATENT AND TRADEMARK OFFICE

CERTIFICATE OF CORRECTION

PATENT NO. : 7,380,781 B2
APPLICATION NO. : 11/470404
DATED : June 3, 2008
INVENTOR(S) : Ikeda It is certified that error appears in the above-identified patent and that said Letters Patent is hereby corrected as shown below:

COLUMN 3:
Line 34, “subject” should read --subjected--.
Line 45, “fed. In” should read --fed. ¶ In--.

COLUMN 4:
Line 33, “blown” should read --blow--.

COLUMN 8:
Line 29, “impellar” should read --impeller--.

Signed and Sealed this

Tenth Day of February, 2009

JOHN DOLL
*Acting Director of the United States Patent and Trademark Office*